United States Patent [19]

Kulikowski

[11] Patent Number: 4,770,236

[45] Date of Patent: Sep. 13, 1988

[54] ROTARY DRYER

[75] Inventor: Ronald A. Kulikowski, Batavia, N.Y.

[73] Assignee: Blaw-Knox Food & Chemical Equipment Co., Buffalo, N.Y.

[21] Appl. No.: 27,346

[22] Filed: Mar. 18, 1987

[51] Int. Cl.[4] ..... F24D 11/00; F24F 5/00

[52] U.S. Cl. ..... 165/86; 165/92; 34/183

[58] Field of Search ..... 165/89, 181, 92, 86, 165/93, 87, 94, 91; 34/183, 179, 180, 181, 182, 124, 125, 140–142; 432/31, 112; 366/144, 147, 149, 325

[56] References Cited

U.S. PATENT DOCUMENTS

| | | | |
|---|---|---|---|
| 464,166 | 12/1891 | Venuleth | 34/179 |
| 2,624,552 | 1/1953 | Rose | 165/87 |
| 3,020,025 | 2/1962 | O'Mara | 34/183 |
| 3,250,321 | 5/1966 | Root | 165/94 |
| 3,285,330 | 11/1966 | Root | 165/86 |
| 3,613,777 | 10/1971 | Nara | 165/86 |
| 4,658,891 | 4/1987 | Wurtz | 34/182 |

FOREIGN PATENT DOCUMENTS

| | | | |
|---|---|---|---|
| 37800 | 2/1909 | Fed. Rep. of Germany | 34/180 |
| 764544 | 12/1956 | United Kingdom | 165/92 |

OTHER PUBLICATIONS

Bethlehem Bulletin 3503 Entitled "The Porcupine Processor." The Bethlehem Corporation, Process Equipment Division, 1980.

*Primary Examiner*—James C. Yeung
*Attorney, Agent, or Firm*—Bacon & Thomas

[57] ABSTRACT

A paddle type rotary dryer includes a hollow shaft and a plurality of tubular members for interconnecting the interior of a shaft with the interior of each of the paddles. The tubular members extend inwardly into the shaft and prevent the flow of condensate from the shaft into the paddles when the paddles are below the shaft. The tubular members also extend outwardly into the hollow portion of each of the paddles for directing steam into the paddles and define an open passageway or slot so that liquid condensate is drained from the paddles and into the shaft when the vanes are disposed above the shaft, and a fluid conduit is adapted to maintain the level of liquid condensate in the shaft at a height which is less than the height of the inwardly directed tubular member.

5 Claims, 3 Drawing Sheets

FIG 3
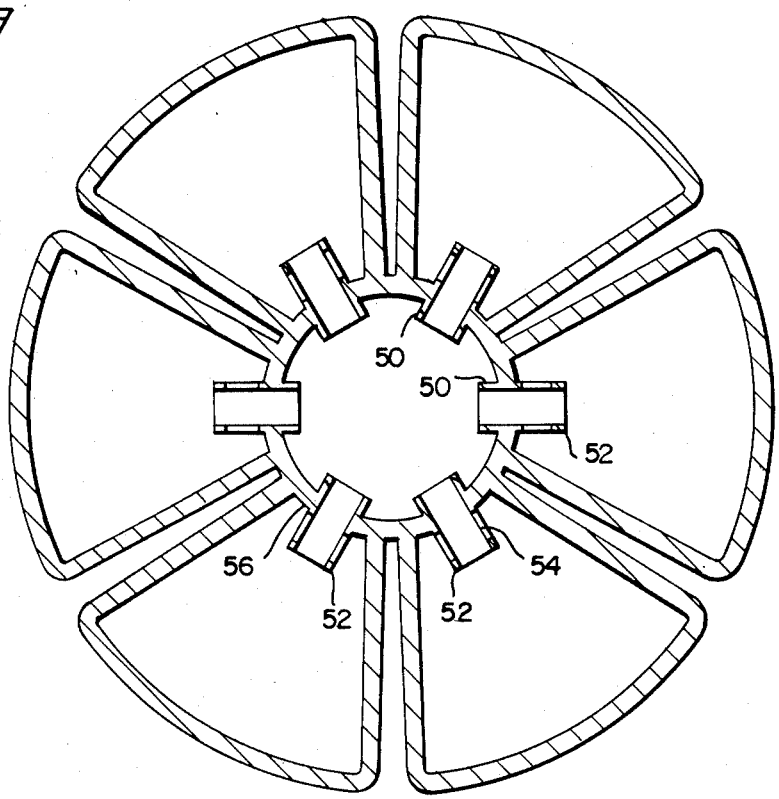
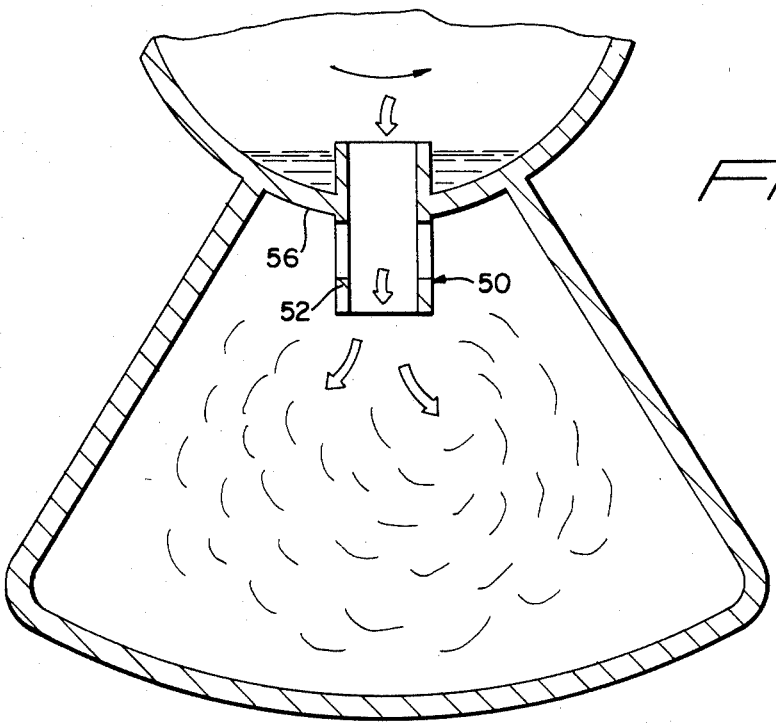
FIG 4

ROTARY DRYER

BACKGROUND OF THE INVENTION

This invention relates to a rotary heat exchanger and more particularly to a rotary dryer having a hollow shaft and a number of hollow vanes or paddles spaced along the shaft for receiving and circulating a heat exchange fluid.

Rotary heat exchangers are well known in the art. For example, the U.S. Pat. No. 3,020,025 of Richard F. O'Mara discloses a longitudinally extending trough or casing and a double hollow shaft assembly extending the length of the casing. Typically, the casing includes an inlet opening at one end thereof for receiving material which is to be heated and/or dried. And then, a discharge port is provided at the other end.

The shaft assembly includes a central portion for the axial passage of a heat transfer fluid such as steam. And spaced longitudinally along the shaft are a number or radially projecting vanes. The vanes are adapted to receive steam or other condensing vapor from the hollow shaft and upon rotation, to heat and move material from the inlet area of the casing towards the discharge port.

There have been a number of approaches for improving the heat transfer or energy efficiency in rotary heat exchangers. For example, the U.S. Pat. No. 3,613,777 of Jiyuichi Nara discloses one such approach. Nara discloses a hollow shaft and a longitudinal separator in the center of the shaft. The heating medium passes through a first chamber formed by the separator and into a vane by means of a tubular conduit. The steam in the vane condenses and water is drained into a second chamber in the shaft.

Nara also discloses a shaft with no separator and the use of steam when water of condensation is small in quantity. In that case communication tubes are formed inside the shaft in a somewhat protruding manner. By so doing, when the revolving body (vane) is rotated and takes its lower position, the steam enters the revolving body through the communication tubes and when the body takes its upper position, water of condensation enters the shaft through communication holes and is discharged from the bottom of the shaft.

It has now been found that rotary dryers made in accordance with the present invention have improved thermal efficiency. In essence, they have improved thermal efficiency because of the effective removal of liquid condensate from the vanes and because any liquid condensate in the hollow shaft is prevented from entering the vanes when the vanes are in their lower position, i.e. disposed below the level of the shaft.

In addition, the rotary dryers disclosed herein have means for directing a condensing heat transfer fluid such as steam into the vanes. They also have means for maintaining the level of liquid condensate in the hollow shaft at less than a predetermined level. And, the dryers can be constructed at an economical cost and in a manner that does not weaken their structural integrity.

Such dryers are thought to be particularly applicable for drying sewage sludge. For example, sewage sludge can be dewatered by centrifuge, vacuum filter or in specially constructed hanging bags to about 20% solid content. This dewatered sludge or sewage is then dried in a rotating dryer according to the present invention. And the dried sludge can then be burned in a multiple hearth furnace with a waste-heat boiler or the like.

Steam generated from the incineration can then be used as the heat transfer fluid for the rotary dryer.

SUMMARY OF THE INVENTION

Briefly, a rotary dryer according to the present invention includes a stationary vessel and a hollow rotatable shaft. The rotatable shaft includes a plurality of hollow vanes fixed thereon and is adapted for rotation within the stationary vessel. A motor or other suitable means rotates the shaft and fluid conduit means delivers steam to the interior thereof. Tubular means interconnect the interior of the vanes with the interior of the shaft and aid in directing and distributing the steam into the vanes. The tubular means extend inwardly into the shaft and prevent the flow of condensate from the shaft into the vanes when the vanes are below the shaft. The tubular means also extend outwardly into the hollow portion of each of the vanes and define an open passageway or slot in a wall of the tubular means so that liquid condensate is drained from the vanes and into the shaft when the vanes are disposed above the shaft. Means are also provided for removing liquid condensate from the hollow shaft and for maintaining the level of liquid condensate in the shaft at a height which is less than the height of said inwardly directed tubular means.

BRIEF DESCRIPTION OF THE DRAWINGS

FIG. 3 is a cross-sectional view taken along line 2—2 of FIG. 2;

FIG. 4 is a partial cross-sectional view along the line 3—3 which illustrates a paddle in its lower position.

DESCRIPTION OF THE PREFERRED EMBODIMENT

Figure 5:
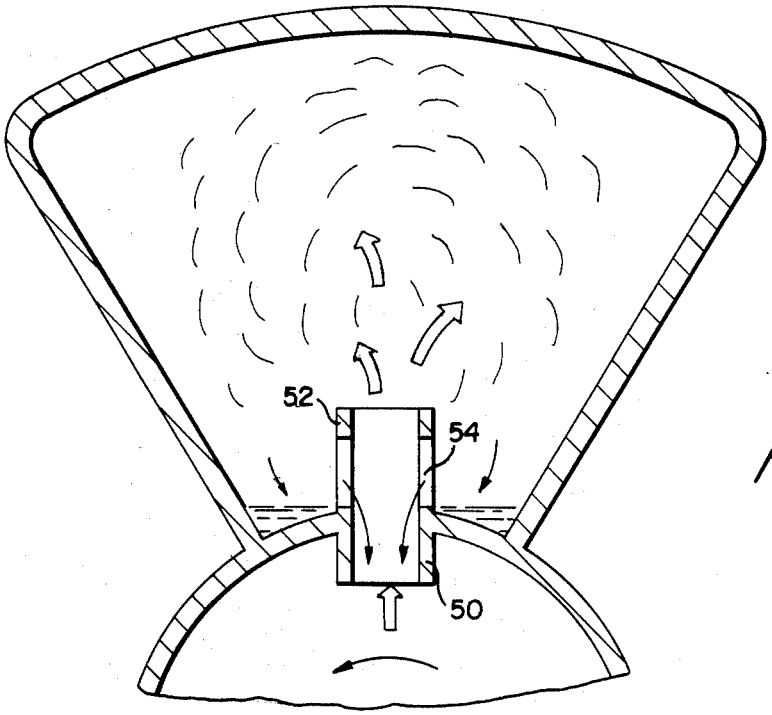
FIG. 5 is a partial cross-sectional view along the line 3—3 which illustrates a paddle in its upper position.

Referring to the drawings, like reference characters designate corresponding parts throughout the several figures.

Figure 1:
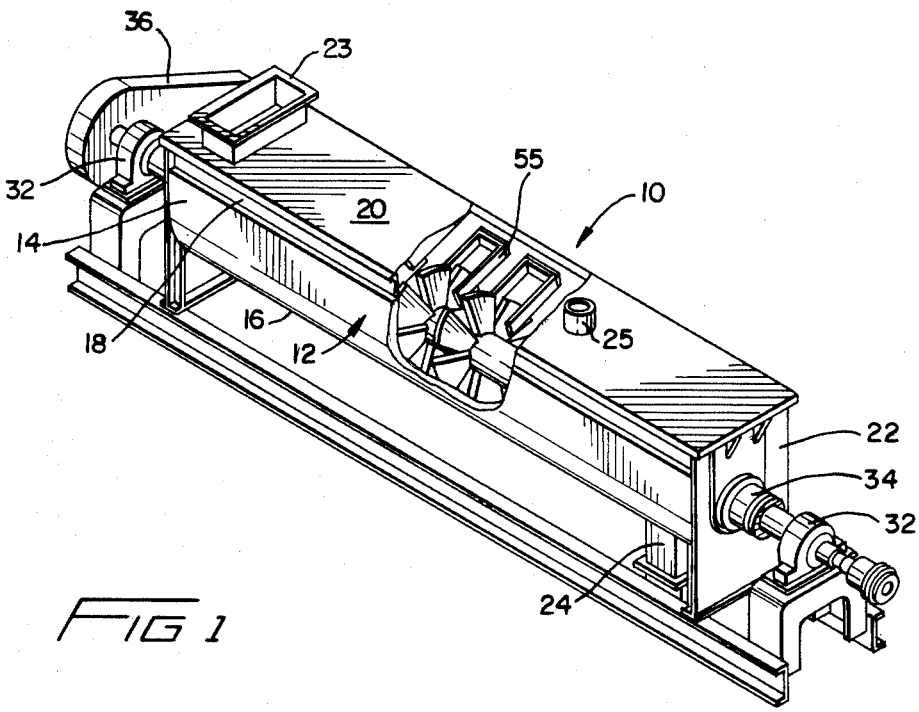
FIG. 1 is a perspective view which illustrates a single shaft rotary dryer according to the present invention.
Figure 2:
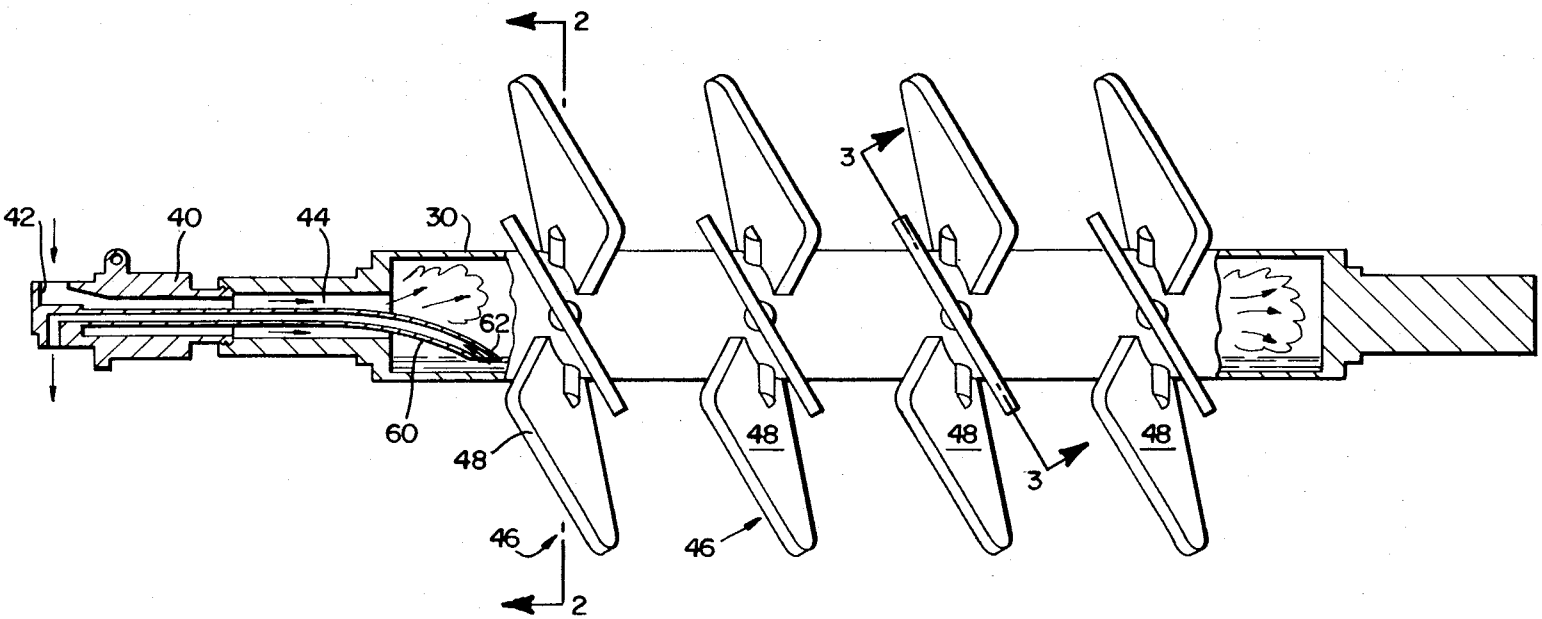
FIG. 2 is a side elevational view which is partly broken away to illustrate a preferred embodiment of the invention.

With respect to FIG. 1, a longitudinally extending heat exchanger mixer or dryer (hereinafter referred to as dryer 10) includes a stationary horizontal trough or vessel 12 and a jacketed casing 14. A lower portion 16 of the vessel 12 defines a semicircular shape that extends along the length of the vessel 12. And in the preferred embodiment the semicircular shape extends longitudinally along the entire lower portion of the vessel 12. A pair of vertical side walls 18 extend upwardly from the semicircular portion and then, a top member or cover 20 and end walls 22 enclose the vessel 12.

A product inlet 23 is provided at the open portion of the vessel 12 and a discharge chute or outlet 24 is provided at the opposite end of the dryer 10, preferably in the lower portion thereof. The product inlet 23 and discharge outlet 24 can be connected to hoppers, conduits, conveyers or other structures (not shown) for bringing material to the dryer 10 and for conveying the dried material therefrom. It may also be desirable to include one or more openings 25 in the top 20 for removal of vapor as material is being dried.

A hollow shaft 30 extends along the longitudinal axis of the vessel 12 and is rotatably mounted therein. The shaft 30 defines an open chamber and is supported at each end by conventional bearings 32. Conventional packing glands or stuffing boxes 34 are disposed in each of a pair of end walls 22 for sealing the shaft 30 and for preventing leakage from the interior of the vessel 12. Outboard of the support bearing 32 at one end of shaft 30 is a drive means 36 such as a reversible motor and gear assembly (not shown) which is operatively connected to shaft 30 for rotation thereof.

At the opposite end of the shaft 30 and beyond bearing 32 is a rotating joint 40 and a fluid coupling 42. The fluid coupling 42 communicates with the interior of the hollow shaft 30 and is connected to a source of steam or other condensing vapor (not shown).

Fluid conduit means 44 connects the interior of the hollow shaft 30 through the fluid coupling 42 with the source of steam or other condensing vapor and is adapted to direct steam into the interior of shaft 30.

In its preferred form the vessel 12 includes a pair of upwardly extending side walls 18 and cover 20. And a steam jacket 14 surrounds the lower portion and a major portion of the side walls 18 along the entire length thereof for providing additional heat to the vessel 12.

A plurality of heat transfer assemblies 46 are disposed at intervals along the shaft 30 and include a plurality of hollow paddles or vanes 48. The vanes 48 are made or fabricated of a heat conducting material such as carbon steel or stainless steel and extend outwardly in a radial direction from the shaft 30. The vanes 48 are preferably fabricated from flat pieces of steel plate with a space between them for the heating medium and and are spaced circumferentially around the shaft 30 to form a heating and a conveying unit. For this reason the vanes 48 are inclined at an angle of between 5° and 45° to a plane which is perpendicular to the axis of the shaft 30 and in planes that are preferably parallel to each other in order to effectively move flowable material along the heat exchanger during operation thereof. However, the angle or degree of inclination of the vanes 48 is preferably about 15° and any deviation from parallel with respect to the vanes in other assemblies can be selected in order to effect the degree of mixing, heating and or the speed with which the material to be heated passes through the dryer 10.

Tubular members 50 extend inwardly into the hollow shaft 30 and include a portion 52 which passes through the wall of the shaft 30 and into the interior of each hollow vane 48. These tubular members 50 are adapted to direct steam from the interior of the shaft 30 into the interior of the hollow vanes 48.

The portion, 52 of tubular members 50 which extend into the hollow vanes 48 also define one or more passageways 54 which are preferably disposed adjacent to or at least in close proximity to the wall 56, that separates the interior of shaft 30 from the interior of paddle 48.

The tubular members 50 extend into the shaft 30 and act in cooperation with the otherwise closed wall 56, i.e., a wall portion that is free of any other opening to prevent liquid condensate from flowing out of the inner portion of shaft 30 and into the hollow vane 48 when the vane is rotated or disposed in its lower position as illustrated in FIG. 4. Nevertheless steam can continue to enter the vane 48 through the tubular member 50.

And, when the vane 48 is rotated into an upper position as illustrated in FIG. 5, steam will continue to enter into the interior of vane 48 through the tubular member 50. However, when the vane is in the upper position, any liquid condensate in the vane 48 will flow through the passageway 54 and into the hollow shaft 30. This passageway 54 preferably defines a hollow slot 54' as illustrated in FIG. 5. In general a pair of hollow slots is preferred.

Means such as a stationary tube or pipe 60 is disposed with one end 62 thereof in a lower portion of the shaft 30. The pipe 60 is fixed in this position and connected through rotary joint 40 to a steam trap, pump or other means (not shown) for removing liquid condensate from the interior of shaft 30. The end 62 of pipe 60 is disposed in close proximity to the bottom of the interior of shaft 30 and is adapted to maintain the level of the liquid condensate at a height which is less than the height of the inwardly protruding tubular member 50. In this way, the level of liquid condensate will be less than the height of the inwardly extending member 50 so that liquid condensate will be prevented from flowing into the vane 48 when the vane 48 is below the level of the shaft 30.

During the operation of a dryer according to the present invention, a powdered material or slurry is introduced into the dryer 10 through the inlet 23 and is moved through the dryer 10 by the rotation of vanes 48 which act like propellers with a pitch of between 5°–45° in moving the material through the dryer. The shaft 30 and heat transfer assemblies 46 are rotated by any suitable drive means 36 such as a motor or gear assembly. In addition to moving the material, vanes 48 are heated by steam which passes into the shaft 30 through conduit 44 and into each of the vanes 48 by means of the tubular member 50.

Additional heat may also be provided through the jacketed side walls and lower portion 12 as will be readily understood by those who are skilled in the art. Then as the material passes through the dryer 10 it is heated by vanes 48. And in some cases it may be desirable to provide breaker bars 55 for breaking up the material and preventing lumps from forming therein.

The heat from the steam is transferred through the vanes 48 and into the material which is to be dried. And as a result of the heat transfer, the steam is converted to a liquid condensate that falls to the bottom of the vane 48 when the vane is rotated through the upper portion of dryer 10. And then, the liquid condensate 64 is drained out of the vanes 48 by means of the passageways 54 and falls into a lower portion of shaft 30.

As the vane 48 is rotated through the lower portion of the dryer 10 as illustrated in FIG. 4, the inwardly directed tubular member 50 acts as a dam and prevents liquid condensate 66 from draining into vane 48. And, the stationary pipe 60 which may be connected to a suitable pump or steam trap removes excess liquid from the shaft 30 and maintains the level of the liquid below the height of the inwardly extending tubular member so that liquid does not flow back into a vane.

The dryer according to the present invention can be constructed with a single shaft as shown or with a plurality of shafts. In either case, the novel construction provides increased utilization of the heat transfer medium which permits faster and more economical drying. And while the operation of the device has been described using steam as the heat transfer medium, the apparatus would also work with any other heat exchange vapor that will form a liquid condensate upon loss of heat.

While the invention has been described with respect to a preferred embodiment, it will be obvious that various modifications may be made by those skilled in the art without departing from the scope of the invention as defined by the claims.

What is claimed is:

1. A rotary dryer comprising a stationary vessel and a hollow rotatable shaft disposed in said vessel along its longitudinal axis for rotation therein, means for rotating said hollow shaft and fluid conduit means for delivering steam, or other vaporized liquid into the interior of said hollow shaft, a plurality of heat exchange assemblies each of which includes a plurality of hollow vanes fixed to said shaft for rotation therewith, tubular means interconnecting the interior of said shaft with the interior of each of said vanes for directing steam from said shaft and into said vanes, said tubular means extending inwardly into said shaft for preventing the flow of condensates from said shaft into said vanes when said vanes are disposed below said shaft, means defining a hollow member extending outwardly and into the hollow portion of each of said vanes and defining a pair of open elongated slots in a wall of each of said hollow members in close proximity to said shaft for draining liquid condensate from said vanes into said hollow shaft when said vanes are disposed above said shaft, and means for removing liquid condensate from said shaft and maintaining the level of liquid condensate in said hollow shaft at a level less than the height of said inwardly directed tubular means.

2. A rotary dryer according to claim 1 wherein six vanes are disposed in groups disposed at intervals along said shaft and in which said means for removing liquid condensate from said shaft and maintaining the level of liquid condensate in said hollow shaft at a level less than the height of said inwardly directed tubular means includes a stationary pipe with one end thereof disposed within a lower portion of said hollow shaft at a distance from the bottom of said shaft which is less than the height of said inwardly directed tubular means.

3. A paddle dryer according to claim 2 which includes at least 4 assemblies each of which includes 6 vanes.

4. A paddle dryer according to claim 6 wherein each of the vanes is inclined at an angle of between 5° and 45° along an axis that is perpendicular to the longitudinal axis of said shaft and with the blades of the vanes approximately parallel to one another so that rotation of the shaft and vanes moves treated material from one end of said vessel toward the other end thereof.

5. A rotary dryer comprising a stationary horizontal vessel including a lower portion having a semicircular cross section along the length thereof and a pair of vertical side walls extending upwardly from said semicircular lower portion, a pair of vertical end walls and a cover for enclosing the vessel, an inlet opening adapted to receive material for drying disposed in an upper portion of the vessel at one end thereof and means including an opening in said cover for evacuating vapors from said vessel, means for discharging material from said vessel disposed in a lower portion thereof at a second end of said vessel which is opposite the inlet opening, and a hollow rotatable shaft and mounting means including a pair of bearings for mounting said shaft within said vessel for rotation therein and means for preventing treated material from leaking out of the vessel in the area that said shaft passes through said end walls, fluid conduit means for delivering steam into the interior of said hollow shaft and a plurality of heat exchange assemblies disposed along and fixed in said shaft for rotation therewith, each of said heat exchange assemblies including six radially extending and generally parallel hollow vanes disposed circumferentially about said shaft and offset from each other by about 60°, each of said vanes inclined at an angle of about 15° to a plane which is perpendicular to the axis of the shaft so that rotation of the shaft and vanes will heat and propel material from one end of said vessel toward said discharge means, tubular means interconnecting the interior of said shaft with the interior of each of said vanes for directing steam from said shaft and into said vanes, said tubular means extending inwardly into said shaft for preventing the flow of condensate from said shaft into said vanes when said vanes are rotated below said shaft, means defining a hollow member extending outwardly into the hollow portion of each of said vanes and defining a pair of open elongated slots in a wall of each of said hollow members in close proximity to said shaft for draining liquid condensate from said vanes into said hollow shaft when said vanes are rotated above said shaft, and means including a stationary pipe with one end thereof disposed within a lower portion of said hollow shaft at a distance from the bottom of said shaft which is less than the height of said inwardly directed tubular means for removing liquid condensate from said shaft and maintaining the level of liquid condensate in said hollow shaft at a level which is less than the height of said inwardly directed tubular means.

* * * * *